United States Patent [19]

Amada et al.

[11] Patent Number: 4,786,573

[45] Date of Patent: Nov. 22, 1988

[54] LAYERED LIGHT RECEIVING MEMBER FOR ELECTROPHOTOGRAPHY COMPRISING BUFFER LAYER

[75] Inventors: Hiroshi Amada; Tetsuya Takei; Naoko Shirai, all of Nagahama, Japan

[73] Assignee: Canon Kabushiki Kaisha, Tokyo, Japan

[21] Appl. No.: 35,392

[22] Filed: Apr. 7, 1987

[30] Foreign Application Priority Data

Apr. 8, 1986 [JP] Japan ..... 61-80377
Apr. 8, 1986 [JP] Japan ..... 61-80378
Apr. 8, 1986 [JP] Japan ..... 61-80379

[51] Int. Cl.[4] ..... G03G 5/082; G03G 5/14
[52] U.S. Cl. ..... 430/65; 430/67
[58] Field of Search ..... 430/64, 65, 67

[56] References Cited

U.S. PATENT DOCUMENTS 4,403,026 9/1983 Shimizu et al. ..... 430/65

*Primary Examiner*—J. David Welsh
*Attorney, Agent, or Firm*—Fitzpatrick, Cella, Harper & Scinto

[57] ABSTRACT

The improvements in the light receiving members in which an aluminum material being used as the substrate for use in electrophotography and in other various devices. The improved light receiving member to be provided is characterized in that a buffer layer functioning to improve the bondability between the aluminum substrate and a light receiving layer to be disposed thereon is disposed between the substrate and said light receiving layer.

The improved light receiving member is satisfactorily free from various problems due to insufficient bondability between the aluminum substrate and the light receiving layer imposed thereon which are found in the conventional light receiving members.

29 Claims, 2 Drawing Sheets

LAYERED LIGHT RECEIVING MEMBER FOR ELECTROPHOTOGRAPHY COMPRISING BUFFER LAYER

FIELD OF THE INVENTION

This invention relates to the improvements in a conventional light receiving member having a photoconductive layer formed of a silicon containing amorphous material on a substrate constituted principally with aluminum material.

BACKGROUND OF THE INVENTION

For the light receiving members for use in electrophotography and the like, the public attention has been focused on such light receiving members that have a photoconductive layer formed of an amorphous material containing silicon atoms as the main constituent atoms and hydrogen atoms (hereinafter referred to as "A-Si:H") as disclosed in Unexamined Japanese Patent Publications Nos. Sho. 54 (1979) - 86341 and Sho. 56 (1981) - 83746 since said photoconductive layer has a high Vickers hardness in addition to having an excellent matching property in the photosensitive region in comparison with that in other kinds of light receiving member and it is not harmful to living things as well as man upon the use.

Further, in recent years, a laser printer using the electrophotographic process in which a semiconductor laser having a wavelength of 770 to 800 nm is used as the light source has been tried to make the device practically usable. Its is known that when there is used a light receiving member having a photoconductive layer formed of a silicon containing amorphous material, especially an A-Si material containing a hydrogen atom (H) and/or a halogen atom (X) [hereinafter referred to as "A-Si(H,X)"] in such laser printer, it becomes necessary to show a desired matching property with the semiconductor laser and to bring about a quick photoresponce because of its high photosensitivity in all the wavelength regions of light and especially because of its superior photosensitivity in the long wavelength region of light in comparision with that of the known light receiving member having a selenium light receiving layer.

Further, for the light receiving member as above mentioned, there has been proposed to dispose between the substrate and the photoconductive layer a high resistance intermediate layer formed of a non-monocrystalline material containing silicon atoms as the main constituent atoms and at least one kind atoms selected from oxygen atoms, carbon atoms and nitrogen atoms or/and a charge injection inhibition layer formed of a non-monocrystalline material containing hydrogen atoms and/or halogen atoms in addition to silicon atoms, and a conductivity controlling element of Group III or Group V of the Periodic Table (hereinafter referred to as "Group III element" and "Group V element" respectively) respectively aiming at inhibiting electrons from being injected into the photoconductive layer from the side of the substrate at the time when the light receiving member is engaged in electrification process and permitting the photocarriers, which will be generated in the photoconductive layer and move toward the substrate side at the time when received irradiation of electromagnetic waves, to pass through the substrate side from the photoconductive layer.

There has been also proposed to dispose a layer functioning to absorb light in the long wavelength region (hereinafter referred to as "IR absorption layer") between the substrate and the photoconductive layer in order to eliminate problems often occurring in the case of conducting image exposure using the semiconductor laser as the light source for the above mentioned light receiving member that the light in the long wavelength region which could not be absorbed by the photoconductive layer reflects on the surface of the substrate to cause the occurrence of interference phenomena.

As such IR absorption layer, there has been proposed such that is formed of an amorphous material containing at least one kind atom selected from silicon atom (Si), germanium atom (Ge) and tin atom (Sn).

Now, FIG. 2 is a schematic cross-sectional view illustrating the typical layer composition of the known light receiving member, in which are shown substrate 101, photoconductive layer 102 and high resistance intermediate layer, charge injection inhibition layer or IR absorption layer 103.

For the electroconductive substrate for use in the known light receiving member having a photoconductive layer formed of an A-Si:H material or an A-Si(H,X), there have been used metals such as Al, Ni, Cr, Mo, Au, Nb, Ta, V, Ti, Pt, Pt, etc. or alloys of two or more of these metals such as stainless steel. Among these metals and alloys, metallic materials, aluminum metal or alloys of which principal constituent is aluminum are most preferably used in the viewpoints of their lightness and treatment easiness and also in the economical viewpoint.

This light receiving members are generally prepared by forming on a substrate each of the foregoing IR absorption layer, charge injection inhibition layer, high resistance intermediate layer and photoconductive layer by means of vacuum evaporation, thermal induced chemical vapor deposition, plasma chemical vapor deposition and reactive sputtering.

However, in the case of forming such layers on a substrate of which principal constituent is aluminum (hereinafter referred to as "aluminum substrate") using such film forming process, it is generally recognized that there are several problems as hereunder mentioned.

That is, because the softening point of aluminum is in the range from 150° C. to 200° C., when the aluminum substrate is heated to about 250° C. and maintained at that temperature, a strain is apt to form on the aluminum substrate during the film forming operation.

Further, because there is a difference of about one digit number between the thermal expansion coefficient of aluminum and that of the high resistance intermediate layer, charge injection inhibition layer or IR absorption layer to be formed thereon, cracks are apt to cause in such layer that sometimes results in making the layer peeled off from the substrate.

In order to eliminate the above problems, there has been proposed a method that the temperature of the layer to be formed on the aluminum substrate is gradually elevated to a desired temperature while maintaining that substrate at a relatively low temperature.

However, such method is accompanied with problems that a layer such as an A-Si:H layer to be formed becomes such that is insufficient in its photosensitivity, the characteristics are varied and the yield is decreased.

Against this background, various devices using a light receiving member have been greatly diversified. There is an increased demand for providing a desirable light receiving member having the required layers being disposed on an aluminum substrate which is free from the problems due to the insufficient bondability between the substrate and the layer to be formed thereon and other problems as above mentioned on the known light receiving member, which has a desirable suitability for use in various devices and which also has a wealth of many practically applicable characteristics capable of satisfying various demands required for such various devices.

SUMMARY OF THE INVENTION

This invention is aimed at eliminating the foregoing problems in the conventional light receiving member having a photoconductive layer forced of a silicon containing amorphous material in which an aluminum material being used as the substrate and providing an improved light receiving member being free from the foregoing problems including those due to the insufficient bondability between the aluminum substrate and the layer to be formed thereon, which has a desired suitability for use in various devices and which is capable of being mass-produced with a high yield.

Another object of this invention to provide a desirable light receiving member having a photoconductive layer formed of a silicon containing amorphous material in which the aluminum substrate being used and the bondability between the aluminum substrate and the high resistance intermediate layer, charge injection inhibition layer or IR absorption layer being extremely improved without hindering the functions required for such layers and which satisfies the foregoing demand.

The present inventors have made earnest studies for overcoming the foregoing problems on the conventional light receiving members and attaining the objects as described above and, as a result, have accomplished this invention based on the finding as described below.

That is, as a result of the earnest studies focusing on the improvements in the bondability between the aluminum substrate and a layer to be formed thereon in the conventional light receiving member having at least one layer selected from the group consisting of high resistance intermediate layer, charge injection inhibition layer and IR absorption layer, and a photoconductive layer in this order on the aluminum substrate, the present inventors have found the facts that when a buffer layer formed of an amorphous material, polycrystalline material or non-monocrystalline material containing aluminum atoms and at least one kind atoms which are the constituent atoms for the high resistance intermediate layer, charge injections inhibition layer or IR absorption layer is disposed between the aluminum substrate and the high resistance intermediate layer, charge injection inhibition layer or IR absorption layer, the bondability between the aluminum substrate and the above layer to be formed thereon can be extremely improved to thereby eliminate the foregoing problems which are found on the conventional light receiving member and the objects of this invention as described above can be satisfactorily attained.

Accordingly, this inventions is characterized in the improvements in the light receiving member comprising an aluminum substrate and a photoconductive layer formed of an amorphous material containing silicon atoms as the main constituent atoms and hydrogen atoms, which comprises disposing on the aluminum substrate the aforementioned buffer layer and at least one kind of layer selected from the group consisting of high resistance intermediate layer, charge injection inhibition layer functioning to inhibit electrons from being injected from the substrate side into the photoconductive layer and IR absorption layer functioning to absorb the remaining light of long wavelength which could not be absorbed by the photoconductive layer, and the photoconductive layer in this order from the side of the substrate.

DETAILED DESCRIPTION OF THE INVENTION

The above-described and other objects, advantages, and features of the invention will become more apparent upon making reference to the specification to follow, the claims and the drawings.

Figure 1:
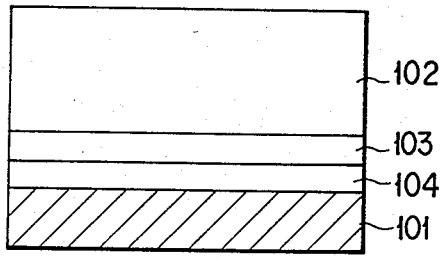
FIG. 1 is a schematic cross-sectional view illustrating a representative embodiment of a light receiving member to be provided according to this invention.
Figure 2:
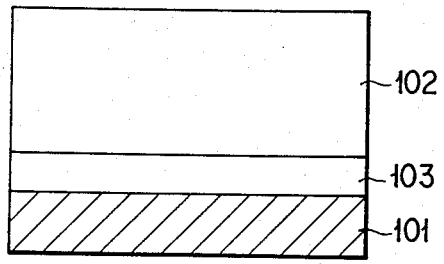
FIG. 2 is a schematic cross-sectional view illustrating the typical conventional light receiving member.

FIG. 1 is a schematic cross-sectional view illustrating a representative embodiment of a light receiving member to be provided according to this invention in which are shown substrate of which principal constituent is aluminum material (hereinafter referred to as "aluminum substrate") 101, photoconductive layer 102, high resistance intermediate layer, charge injection inhibition layer or IR absorption layer 103 and buffer layer 104.

Substrate 101

The configuration of the aluminum substrate 101 to be used in the light receiving member of this invention may be either endless belt or cylindrical form. And the thickness of the substrate is properly determined so that the light receiving member as desired can be formed. In the case where flexibility is required for the light receiving member, it can be made as thin as possible within a range capable of sufficiently providing the functions as the substrate. However, the thickness is usually greater than 10 μm in view of the fabrication and handling or mechanical strength of the substrate.

Photoconductive Layer 102

The photoconductive layer 102 is in the light receiving member of this invention is constituted with A-Si(H,X), and the halogen atoms (X) to be incorporated in the layer in case where necessary can include fluorine, chlorine, bromine and iodine. And among these halogen atoms, fluorine and chlorine are particularly preferred. The amount of the hydrogen atoms (H), the amount of the halogen atoms (X) or the sum of the amounts for the hydrogen atoms and the halogen atoms (H+X) to be incorporate in the photoconductive layer is preferably 1 to $4\times10$ atomic %, more preferably, 5 to $3\times10$ atomic %.

The photoconductive layer constituted with A-Si(H,X) may contain group III element or group V element respectively having a relevant function to control the conductivity of the photoconductive layer, whereby the photo-sensitivity of the layer can be improved.

Specifically, the group III element can include B (boron), Al (aluminum), Ga (gallium), In (indium) and Ti (thallium), B and Ga being particularly preferred. The group V element can include, for example, P (phosphorus), As (arsenic), Sb (antimony) and Bi (bismuth), P and Sb being particularly preferred.

The amount of the group III element or the group V element to be incorporated in the photoconductive layer 102 is preferably $1\times10^{-3}$ to $1\times10^{3}$ atomic ppm, more preferably, $5\times10^{-2}$ to $5\times10^{2}$ atomic ppm, and most preferably, $1\times10^{-1}$ to $2\times10^{2}$ atomic ppm.

Further, in order to improve the quality of the photoconductor layer and to increase its dark resistance, at least one kind selected from oxygen atoms, carbon atoms and nitrogen atoms can be incorporated in the photoconductive layer. The amount of these atoms to be incorporated in the photoconductive layer is preferably 10 to $5\times10^{5}$ atomic ppm, more preferably 20 to $4\times10^{5}$ atomic ppm, and, most preferably, 30 to $3\times10^{5}$ atomic ppm.

The thickness of the photoconductive layer 102 is an important factor in order to effectively attain the object of this invention. The thickness of the photoconductive layer is, therefore, necessary to be carefully determined having due regards so that the resulting light receiving member becomes accompanied with desired characteristics.

In view of the above, the thickness of the photoconductive layer 102 is preferably 1 to 100 μm, more preferably 3 to 80 μm, and most preferably 5 to 50 μm.

High Resistance Intermediate Layer 103

The high resistance intermediate layer 103 in the light receiving member of this invention is to be disposed under the above mentioned photoconductive layer 102.

The high resistance intermediate layer 103 is constituted with an A-Si(H,X) material containing at least one kind selected from oxygen atoms, carbon atoms and nitrogen atoms (hereinafter referred to as "A-Si(O,C,N)(H,X)"), polycrystlline Si(O,C,N)(H,X) material (hereinafter referred to as "poly-Si(O,C,N)(H,X)") or so-called non-monocrystalline material containing the above mentioned two kinds of materials (hereinafter referred to as "Non-Si(O,C,N)(H,X)"). (Note: So-called microlite silicon is classified in the category of A-Si).

The high resistance intermediate layer 103 in the light receiving member of this invention functions to inhibit electrons from being injected into the photoconductive layer 102 from the side of the substrate 101 at the time when the light receiving member is engaged in electrification process and to permit the photocarriers, which will be generated in the photoconductive layer 102 and move toward the side of the substrate 101 when received irradiation of electromagnetic waves, to pass through the side of the substrate 101 from the photoconductive layer 102.

In view of this, the amount of at least one kind atoms selected from oxygen atoms, carbon atoms and nitrogen atoms to be incorporated into the high resistance intermediate layer 103 in the light receiving member of this invention is an important factor in order to effectively attain the objects of this invention. And it is preferably 10 to $5\times10^{5}$ atomic ppm, preferably 20 to $4\times10^{5}$ atomic ppm, and most preferably 30 to $3\times10^{5}$ atomic ppm.

Likewise, the thickness of the high resistance intermediate layer 103 is also an important factor, and it is preferably 0.03 to 15 μm, more preferably 0.04 to 10 μm, and most preferably, 0.05 to 8 μm.

Charge Injection Inhibition Layer 103

The charge injection inhibition layer in the light receiving member is to be disposed under the above mentioned photoconductive layer 102. And the charge injection inhibition layer is constituted with an A-Si(H,X) material containing group III element or group V element [hereinafter referred to as "A-Si(III,V):(H,X)"], a poly-Si(H,X) material containing group III element or group V element [hereinafter referred to as "poly-Si(III,V):(H,X)"] or a non-monocrystalline material containing the above two materials [hereinafter referred to as "Non-Si(III,V):(H,X)"].

The charge injection inhibition layer 103 in the light receiving member of this invention functions to maintain an electric charge at the time when the light receiving member is engaged in electrification process and also to contribute to improving the photoelectrographic characteristics of the light receiving member.

In view of the above, the amount of either the group III element or the group V element to be incorporated into the charge injection inhibition layer is an important factor therefor to efficiently exhibit the foregoing functions.

Specifically, it is preferably 3 to $5\times10^{4}$ atomic ppm, more preferably 50 to $1\times10^{4}$ atomic ppm, and most preferably $1\times10^{2}$ to $5\times10^{3}$ atomic ppm.

As for the hydrogen atoms (H) and the halogen atoms (X) to be incorporated into the charge injection inhibition layer, the amount of the hydrogen atoms (H), the amount of the halogen atoms (X) or the sum of the amounts of the hydrogen atoms and the halogen atoms (H+X) is preferably $1\times10^{3}$ to $7\times10^{5}$ atomic ppm, and most preferably, $1\times10^{3}$ to $2\times10^{5}$ atomic ppm in the case where the charge injection inhibition layer is constituted with a poly-Si(III,V):(H,X) material and $1\times10^{4}$ to $6\times10^{5}$ atomic ppm in the case where the charge injection inhibition layer is constituted with an A-Si(III,V):(H,X) material.

Further, it is possible to incorporate at least one kind atoms selected from oxygen atoms, nitrogen atoms and carbon atoms into the charge injection inhibition layer aiming at improving the bondability of the charge injection inhibition layer not only with the buffer layer 104 but also with the photoconductive layer 102.

In that case, the amount of one or more of these atoms to be incorporated in that layer is preferably 10 to $5\times10^{5}$ atomic ppm, more preferably 20 to $4\times10^{5}$ atomic ppm, and most preferably, 30 to $3\times10^{5}$ atomic ppm.

The thickness of the charge injection inhibition layer 103 in the light receiving member is an important factor also in order to make the layer to efficiently its functions.

In view of the above, the thickness of the charge injection inhibition layer 103 is preferably 0.03 to 15 μm, more preferably 0.04 to 10 μm, and most preferably, 0.05 to 8 μm.

IR Absorption Layer 103

The IR absorption layer 103 in the light receiving member of this invention is to be disposed under the foregoing photoconductive layer 102.

And the IR absorption layer is constituted with an A-Si(H,X) material containing germanum atoms (Ge) or/and tin atoms (Sn) [hereinafter referred to as "A-Si(-

Ge,Sn) (H,X)"], a poly-Si(H,X) material containing germanum atoms (Ge) or/and tin atoms (Sn) [hereinafter referred to as "poly-Si(Ge,Sn)(H,X)"] or a non-monocrystalline material containing the above two materials [hereinafter referred to as "Non-Si(Ge,Sn)(H,X)"].

As for the germanum atoms (Ge) and the tin atoms (Sn) to be incorporated into the IR absorption layer, the amount of the germanum atoms (Ge), the amount of the tin atoms (Sn) or the sum of the amounts of the germanum atoms and the tin atoms (Ge+Sn) is preferably 1 to $1\times10^6$ atomic ppm, more preferably $1\times10^2$ to $9\times10^5$ atomic ppm, and most preferably, $5\times10^2$ to $8\times10^5$ atomic ppm.

And, the thickness of the IR absorption layer 103 is preferably 30 Å to 50 μm, more preferably 40 Å to 40 μm, and most preferably, 50 Å to 30 μm.

Now, in the light receiving member of this invention, it is possible to dispose the aforementioned charge injection inhibition layer between the above IR absorption layer and the aforementioned photoconductive layer 102.

Further, in the light receiving member of this invention, it is possible to dispose an intermediate layer other than the aforementioned high resistance intermediate layer between the above IR absorption layer or the aforementioned charge injection inhibition layer and the photoconductive layer. In that case, said intermediate layer is one that is constituted with an A-Si material, a poly-Si material or a Non-Si material respectively containing at least one kind atoms selected from oxygen atoms, carbon atoms and nitrogen atoms in the amount of preferably 10 to $5\times10^5$ atomic ppm, more preferably 20 to $4\times10^5$ atomic ppm, or most preferably 30 to $3\times10^5$ atomic ppm. And the thickness of such intermediate layer is preferably 0.03 to 15 μm, more preferably 0.04 to 10 μm, and most preferably, 0.05 to 8 μm.

Further in addition, in the light receiving member of this invention, it is possible to make the above mentioned IR absorption layer to be such that can function not only as the IR absorption layer but also as the charge injection inhibition layer. In that case, the object can be attained by incorporating either the group III element or the group V element which is the constituent of the aforementioned charge injection inhibition layer or at least one kind atoms selected from oxygen atoms, carbon atoms and nitrogen atoms into the above IR absorption layer.

Buffer Layer 104

The buffer layer 104 in the light receiving member of this invention is to be disposed between the aluminum substrate 101 and the high resistance intermediate layer, the charge injection inhibition layer or the IR absorption layer.

And the buffer layer 104 in the light receiving member of this invention functions to improve the bondability between the aluminum substrate 102 and the high resistance intermediate layer, the charge injection inhibition layer or the IR absorption layer without hindering the original functions which are to be exhibited by such layer and contributes to increasing the yield of a desired light receiving member.

The buffer layer 104 is constituted with an amorphous, polycrystalline or non-monocrystalline materials respectively containing aluminum atoms and at least one kind of the constituent atoms of the high resistance intermediate layer, the charge injection inhibition layer or the IR absorption layer.

The thichkness of the buffer layer 104 in the light receiving member of this invention is also important. It is preferably 0.03 to 10 μm, more preferably 0.04 to 8 μm, and most preferably, 0.05 to 8 μm.

Surface Layer

In the light receiving member of this invention, it is possible to dispose an appropriate surface layer on the foregoing photoconductive layer 102.

In that case, the surface layer can be such that is constituted with an A-Si(H,X) material containing at least one kind atoms selected from oxygen atoms, carbon atoms and nitrogen atoms, that is an A-Si(O,C,N)(H,X) material.

To dispose such surface layer on the photoconductive layer 102 contributes to improving the humidity resistance, deterioration resistance upon repeating use, breakdown voltage resistance, use-environmental characteristics and durability of the light receiving member according to this invention.

And in the case of disposing a surface layer formed of an A-Si(O,C,N)(H,X) material on the foregoing photconductive layer 102, since the surface layer contains silicon atoms as the constituent atoms which are contained in the photoconductive layer as the main constituent atoms, the interface between the two layers is always maintained in chemically stable state.

As for the oxygen atoms, carbon atoms and nitrogen atoms which are selectively contained in the surface layer, the above mentioned various characteristics will be increased with increasing their amount, but in the case of incorporating an excessive amount of such atoms into the surface layer, not only the layer quality but also the electric and mechanical characteristics will be undesirably declined.

In view of the above, the amount of at least one kind atoms selected from oxygen atoms, carbon atoms and nitrogen atoms is preferably 0.001 to 90 atomic %, more preferably 1 to 90 atomic %, and most preferably, 10 to 90 atomic %.

The thickness of the surface layer in the light receiving member of this invention is appropriately determined depending upon the desired purpose.

It is, however, also necessary that the thickness be determined in view of relative and organic relationship in accordance with the amounts of the constituent atoms to be contained in the layer or the characteristics required in the relationship with the thickness of other layer. Further, it should be determined also in economical viewpoints such as productivity or mass productivity.

In view of the above, the thickness of the surface layer is preferably $3\times10^{-3}$ to 30 μm, more preferably, $4\times10^{-3}$ to 20 μm, and, most preferably, $5\times10^{-3}$ to 10 μm.

As above explained, the light receiving member to be provided according to this invention is that a buffer layer 104, at least one layer 103 selected from the group consisting of high resistance intermediate layer, charge injection inhibition layer, IR absorption layer, an intermediate layer in case where necessary, a photoconductive layer 102, and if necessary, a surface layer are disposed in this order on an aluminum substrate 101.

For the formation of each of the above mentioned constituent layers to prepare the objective light receiving member of this invention, any of the known film forming processes such as thermal induced chemical vapor deposition process, plasma chemical vapor deposition process, reactive sputtering process and light induced chemical vapor deposition process can be selectively employed. And among these processes, the plasma chemical vapor deposition process is the most appropriate.

For instance, in the case of forming a layer composed of a poly-Si(Ge,Sn)(H,X) by means of plasma chemical vapor deposition (commonly abbreviated to "plasma CVD"), the film forming operation is practiced while maintaining the substrate at a temperature from 400° to 450° C. in a deposition chamber.

In another example of forming a layer composed of a poly-Si(Ge,Sn)(H,X), firstly, an amorphous-like film is formed on the substrate being maintained at about 250° C. in a deposition chamber by means of plasma CVD, and secondly the resultant film is annealed by heating the substrate at a temperature of 400° to 450° C. for about 20 minutes or by irradiating laser beam onto the substrate for about 20 minutes to thereby form said layer.

DESCRIPTION OF THE PREFERRED EMBODIMENTS

This invention will be described more specifically while referring to Examples 1 through 11, but the invention is not intended to limit the scope only to these examples.

Figure 3:
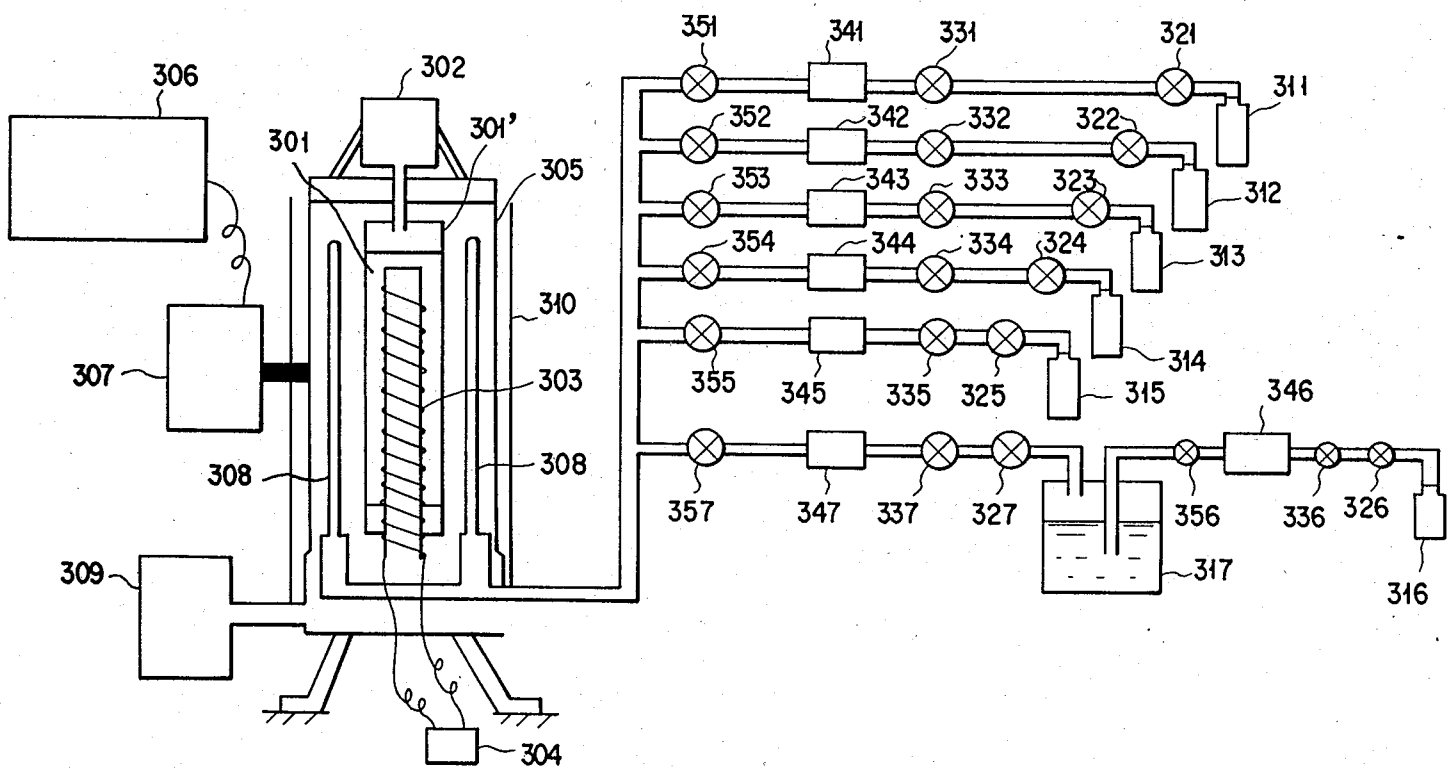
FIG. 3 is a schematically explanatory view of a high frequency plasma deposition system for preparing a light receiving member according to this invention.

FIG. 3 is a schematically explanatory view of a high frequency plasma deposition system for preparing a light receiving member according to this invention.

Referring FIG. 3, there is shown an aluminum cylinder 301' placed on a substrate holder 301 having a electric heater 303 being electrically connected to power source 304.

The substrate holder 301 is mechanically connected through a rotary shaft to a motor 302 so that the aluminum cylinder 301' may be rotated. The electric heater 303 surves to heat the aluminum cylinder 301' to a predetermined temperature and maintain it at that temperature, and it also serves to aneal the deposited film. 305 stands for the side wall of the deposition chamber.

The side wall 305 acts as a cathode, and the aluminum cylinder 301 is electrically grounded and acts as an anode.

High frequency power source 306 is electrically connected through matching box 307 to the side wall 305 and supplies a high frequency power to the side wall 305 as the cathode to thereby generate a discharge between the cathod and the anode.

308 stands for a raw material gas feed pipe having a plurality of gas liberation holes to liberate a raw material gas toward the aluminum cylinder 301. 309 stands for exhaust system having a diffusion pump and mechanical booster pump to evacuate the air in the deposition chamber. The outer wall face of the deposition chamber is protected by shield member 310.

The other end of each of the raw material gas feed pipes 308, 308, . . . is connected to raw material gas reservoirs 311, 312, 313, 314, 315 and 316. An appropriate raw material gas is reserved in each of the raw material gas reservoirs 311 through 316. For example, there are reserved $H_2$ gas in the gas reservoir 311, silane ($SiH_4$) gas in the gas reservoir 312, $B_2H_6$ gas in the gas reservoir 313, $GeH_4$ gas in the gas reservoir 314, $CH_4$ gas in the gas reservoir 315 and He gas in the gas reservoir 316. 317 stands for bubbling vessel containing Al $(C_2H_5)_3$ which is bubbled by blowing He gas from the gas reservoir 316 thereinto to thereby cause a gas containing $Al(C_2H_5)_3$.

From the gas reservoirs 311 through 316 and from the bubbling vessel 317, corresponding raw material gases are supplied into the raw material gas feed pipe 308 through main valves 321 through 327, inlet valves 331 through 337, mass flow controllers 341 through 347 and exit valves 351 through 357.

EXAMPLE 1

A light receiving member having buffer layer, high resistant intermediate layer, photoconductive layer and surface layer on an aluminum cylinder was prepared using the apparatus shown in FIG. 3.

Prior to entrance of the raw material gases into the deposition chamber, all the main valves 321 through 326 of the gas reservoirs 311 through 316 and the main valve 327 were closed, and the mass flow controllers 341 through 347, the inlet valves 331 through 337 and the exit valves 351 through 357 were opened. Then, the related inner atmosphere was brought to a vacuum of $10^{-7}$ Torr by operating the diffusion pump of the exhaust system 309. At the same time, the electric heater 303 was activated to uniformly heat the aluminum cylinder 301' to about 250° C. and the aluminum cylinder was maintained at that temperature.

Thereafter, closing all the inlet valves 331 through 337 and the exit valves 351 through 357 and opening the gas reservoirs 311 through 316, the secondary pressure of each of the main valves 321 through 327 was adjusted to be 15 kg/cm$^2$ using the booster pump in stead of the diffusion pump.

Then, regulating the corresponding valves, $SiH_4$ gas from the gas reservoir 312, $CH_4$ gas from the gas reservoir 315 and a gas containing $Al(C_2H_5)_3$ generated by blowing He gas into the bubbling vessel 317 (He/$Al(C_2H_5)_3$=10/1) were fed into the deposition chamber at a flow rate of 100 SCCM, 30 SCCM and 10 SCCM respectively. After the flow rates of these gases became stable, the high frequency power source 302 was switched on to apply a discharge energy of 150 W resulting in generating gas plasmas in the deposition chamber.

This state maintained to form a layer to be the buffer layer of 10 Å in thickness on the aluminum cylinder.

Successively, the above procedures were repeated, except that the introduction of the gas containing $Al(C_2H_5)_3$ was stopped by closing the exit valve 357, to thereby form a layer to be the high resistant intermediate layer of 100 Å in thickness on the previously formed buffer layer.

Then, closing the exit valve 355 to stop the introduction of $CH_4$ gas and opening the exit valve 351 to introduce $H_2$ gas, the $H_2$ gas and the $SiH_4$ gas were together introduced into the deposition chamber at a flow rate of 300 SCCM and 150 SCCM respectively to thereby a layer composed of A-Si:H to be the photoconductive layer of 20 μm in thickness on the previously formed high resistant intermediate layer.

Finally, switching off the high frequency power source 302 and closing the exit valve 351 to stop the introduction of $H_2$ gas, the $SiH_4$ gas and the $CH_4$ gas were together introduced into the deposition chamber, wherein the flow rate for the $SiH_4$ gas was adjusted to 35 SCCM and the $CH_4$ gas was adjusted to be the flow ratio of $SiH_4/CH_4$=1/30. After the flow rates of these gases became stable, the high frequency power source was switched on to apply a discharge energy of 150 W resulting in generating gas plasmas.

This state maintained to form a layer composed of A-Si:C:H to be the surface layer of 0.5 μm in thickness on the previously formed photoconductive layer.

The high frequency power source was switched off, the related exit valves for the raw material gases were closed, the electric heater was switched off, and the vacuum atmosphere in the deposition chamber was released to atmospheric pressure.

After the aluminum cylinder being cooled to room temperature, it was taken out from the deposition chamber.

The thus obtained light receiving member was applied to positive corona discharge with a power source voltage of 5.0 KV for 0.3 second, and soon after this, the image exposure was conducted by irradiating an exposure quantity of 0.7 lux.sec through a transparent test chart using a tungsten lamp as a light source. Then, the image was developed with a negatively charged toner (containing a toner and a toner carrier) in accordance with the cascade method to develop an excellent toner image on the member surface.

The developed image was transferred to a transfer paper by applying positive corona discharge with a power source voltage of 5.0 KV and then fixed so that an extremely sharp image with a high resolution was obtained.

It was also found that defects chiefly due to insufficient contact between the intermediate layer and the substrate which are often found in the known light receiving member were remarkably eliminated and the yield was improved because of disposing the buffer layer.

EXAMPLE 2

The procedures of Example 1 were repeated, except that $NH_3$ gas was used in stead of the $CH_4$ gas and the film forming conditions were changed as shown in Table 1 to thereby obtain a desirable light receiving member.

EXAMPLE 3

A light receiving member having on an aluminum cylinder a buffer layer, a high resistant intermediate layer and a photoconductive layer was prepared under the film forming conditions shown in Table 1 in the same way as in Example 1 wherein $O_2$ gas was used in stead of the $CH_4$ gas.

In this example, since $O_2$ gas is highly reactive with $SiH_4$ gas, the $O_2$ gas was fed through an independent feed pipe (not shown in FIG. 3) into the deposition chamber.

EXAMPLE 4

The same procedures of Example 1 were repeated, except that the film forming conditions were changed as shown in Table 1, to thereby prepare a light receiving member having a buffer layer, a high resistant intermediate layer and a photoconductive layer on an aluminum cylinder.

As a result of conducting various evaluations on the light receiving members obtained in Examples 2 to 3 in accordance with the same procedures as in Example 1, it was found for each of the light receiving members that the bondability of the intermediate layer with the aluminum cylinder has been remarkably improved and it has a wealth of practically applicable photoelectric characteristics.

TABLE 1

| Example No. | Buffer Layer | Intermediate Layer | Photoconductive Layer | Surface Layer |
|---|---|---|---|---|
| 1 | $SiH_4$ 100 SCCM<br>$CH_4$ 30 SCCM<br>He/Al $(C_2H_5)_3$ = 10/1<br>10 SCCM<br>Layer thickness<br>10 Å | $SiH_4$ 100 SCCM<br>$CH_4$ 30 SCCM<br>Layer thickness<br>100 Å | $SiH_4$ 150 SCCM<br>$H_2$ 300 SCCM<br>Layer thickness<br>20 μm | $SiH_4$ 35 SCCM<br>$CH_4$ 1050 SCCM<br>Layer thickness<br>0.5 μm |
| 2 | $SiH_4$ 100 SCCM<br>$NH_3$ 30 SCCM<br>He/Al$(C_2H_5)_3$ = 10/1<br>10 SCCM<br>Layer thickness<br>10 Å | $SiH_4$ 100 SCCM<br>$NH_3$ 30 SCCM<br>Layer thickness<br>100 Å | $SiH_4$ 150 SCCM<br>$H_2$ 300 SCCM<br>Layer thickness<br>20 μm | $SiH_4$ 35 SCCM<br>$CH_4$ 1050 SCCM<br>Layer thickness<br>0.5 μm |
| 3 | $O_2$ 30 SCCM<br>He/Al$(C_2H_5)_3$ = 10/1<br>10 SCCM<br>Layer thickness<br>10 Å | $SiH_4$ 100 SCCM<br>$O_2$ 30 SCCM<br>Layer thickness<br>100 Å | $SiH_4$ 150 SCCM<br>$H_2$ 300 SCCM<br>Layer thickness<br>20 μm | $SiH_4$ 35 SCCM<br>$CH_4$ 1050 SCCM<br>Layer thickness<br>0.5 μm |

EXAMPLE 5

A layer containing aluminum atoms and silicon atoms of 100 Å in thickness to be the buffer layer was formed on an aluminum cylinder in accordance with the reactive sputtering process using an Al wafer and a Si wafer as targets.

Thereafter, three successive layers to be the high resistant intermediate layer, photoconductive layer and surface layer were continueously formed on the previously formed buffer layer in the same was as in Example 1 using the apparatus shown in FIG. 3 to thereby obtain a light receiving member.

As a result of conducting various evaluations on the resultant light receiving member, it was found that the bondability of the intermediate layer for the resultant light receiving member has been remarkably improved, and the light receiving member is desirably usable in electrophotography since it was a wealth of practically applicable electrophotographic characteristics.

EXAMPLE 6

A light receiving member having a buffer layer, charge injection inhibition layer, photoconductive layer and surface layer on an aluminum cylinder using the apparatus shown in FIG. 3.

Prior to entrance of the raw material gases into the deposition chamber, all the main valves 321 through 326 of the gas reservoirs 311 through 316 and the main valve 327 were closed, and the mass flow controllers 341 through 347, the inlet valves 331 through 337 and the exit valves 351 through 357 were opened.

Then, the related inner atmosphere was brought to a vacuum of $10^{-7}$ Torr by operating the diffusion pump of the exhaust system 309. At the same time, the electric heater 303 was activated to uniformly heat the aluminum cylinder 301' to about 250° C. and the aluminum cylinder was maintained at that temperature.

Thereafter, closing all the inlet valves 331 through 337 and the exit valves 351 through 357 and opening the gas reservoirs 311 through 316, the secondary pressure of each of the main valves 321 through 327 was adjusted to be 15 kg/cm$^2$ using the booster pump in stead of the diffusion pump. Then, regulating the corresponding valves, $SiH_4$ gas from the gas reservoir 312, $CH_4$ gas from the gas reservoir 315 and a gas containing $Al(C_2H_5)_3$ generated by blowing He gas into the bubbling vessel 317 ($He/Al(C_2H_5)_3=10/1$) were fed into the deposition chamber at a flow rate of 100 SCCM, 30 SCCM and 10 SCCM respectively. After the flow rates of these gases became stable, the high frequency power source 302 was switched on to apply a discharge energy of 150 W resulting in generating gas plasmas in the deposition chamber.

This state maintained to form a layer to be the buffer layer of 100 Å in thickness on the aluminum cylinder.

Successively, closing the valves 356, 357 to stop the introduction of the gas containing $Al(C_2H_5)_3$, the mass flow controller 341 was adjusted to 300 SCCM and $H_2$ gas from the gas reservoir 311 was fed into the deposition chamber by opening the related valves. At the same time, the mass flow controller 342 relative to $SiH_4$ gas was adjusted to 150 SCCM and the mass flow controller 343 was adjusted to such flow rate that the amount to be fed of $B_2H_6$ gas from the gas reservoir 313 could be a 1600 vol.ppm.

After the inner pressure of the deposition chamber became stable to be about 0.2 Torr, the high frequency power source 302 was switched on to apply a discharge energy of 150 W resulting in generating gas plasmas in the deposition chamber.

This state maintained to form a layer composed of a p-type A-Si:H to be the charge injection inhibition layer of 5 μm in thickness on the previously formed buffer layer.

Successively, not switching off the high frequency power source, the above procedures were repeated, except that the introduction of the $B_2H_6$ gas was stopped by closing the valves 333 and 353, to thereby form a layer composed of A-Si:H to be the photoconductive layer of 20 μm in thickness.

Then, switching off the high frequency power source once, the introduction of the $H_2$ gas was stopped by closing the valve 351 and $CH_4$ gas from the gas reservoir 315 was fed. At that time, the flow rate of the $SiH_4$ gas was changed to 35 SCCM and the flow ratio of the $SiH_4$ gas to the $CH_4$ gas was adjusted to be a $SiH_4/CH_4=1/30$. After the flow rates of these gases became stable, the high frequency power source was switched on to apply a discharge energy of 150 W resulting in generating gas plasmas.

This state continued to form a layer composed of A-Si:C:H to be the surface layer of 0.5 μm in thickness on the previously formed photoconductive layer whereby a light receiving member was prepared.

The high frequency power source was switched off, the related exit valves for the raw material gases were closed, the electric heater was switched off, and the vacuum atmosphere in the deposition chamber was released to atmospheric pressure.

After the aluminum cylinder being cooled to room temperature, it was taken out from the deposition chamber.

The thus obtained light receiving member was applied to positive corona discharge with a power source voltage of 5.0 KV for 0.3 second, and soon after this, the image exposure was conducted by irradiating an exposure quantity of 0.7 lux.sec through a transparent test chart using a tungsten lamp as a light source. Then, the image was developed with a negatively charged toner (containing a toner and a toner carrier) in accordance with the cascade method to develop an excellent toner image on the member surface.

The developed image was transferred to a transfer paper by applying positive corona discharge with a power source voltage of 5.0 KV and then fixed so that an extremely sharp image with a high resolution was obtained.

It was also found that defects chiefly due to insufficient contact between the charge injection inhibition layer and the substrate which are often found in the known light receiving member were remarkably eliminated and the yield was improved because of disposing the buffer layer.

EXAMPLE 7

The products of Example 6 were repeated, except that $PH_3$ gas was used instead of the $B_2H_6$ gas to be used in the case of forming the charge injection inhibition layer and its flow amount was controlled to be 500 vol.ppm. against the flow amount of the $SiH_4$ gas, to thereby prepare a light receiving member.

As a result of conducting the same image forming evaluations as in Example 6 on the resultant light receiving member, it was found that the light receiving member has a wealth of practically applicable photoelectrographic characteristics.

It was also found that defects chiefly due to insufficient contact between the intermediate layer and the substrate which are often found in the known light receiving member were remarkably eliminated and the yield was improved because of disposing the buffer layer.

EXAMPLE 8

A light receiving member having a buffer layer, IR absorption layer, photoconductive layer and surface layer on an aluminum cylinder was prepared using the apparatus shown in FIG. 3.

Prior to entrance of the raw material gases into the deposition chamber, all the main valves 321 through 326 of the gas reservoirs 311 through 316 and the main valve 327 were closed, and the mass flow controllers 341 through 347, the inlet valves 331 through 337 and the exit valves 351 through 357 were opened. Then, the related inner atmosphere was brought to a vacuum of $10^{-7}$ Torr by operating the diffusion pump of the exhaust system 309.

At the same time, the electric heater 303 was activated to uniformly heat the aluminum cylinder 301' to about 250° C. and the aluminum cylinder was maintained at that temperature.

Thereafter, closing all the inlet valves 331 through 337 and the exit valves 351 through 357 and opening the gas reservoirs 311 through 316, the secondary pressure of each of the main valves 321 through 327 was adjusted to be 15 kg/cm$^2$ using the mechanical booster pump in stead of the diffusion pump. Then, regulating the corresponding valves, $SiH_4$ gas from the gas reservoir 312, $CH_4$ gas from the gas reservoir 315 and a gas containing $Al(C_2H_5)_3$ generated by blowing He gas into the bubbling vessel 317 ($He/Al(C_2H_5)_3=10/1$) were fed into the deposition chamber at a flow rate of 100 SCCM, 30 SCCM and 10 SCCM respectively.

After the flow rates of these gases became stable, the high frequency power source 302 was switched on to apply a discharge energy of 150 W resulting in generating gas plasmas in the deposition chamber.

This state maintained to form a layer to be the buffer layer of 10 Å in thickness on the aluminum cylinder.

Successively, switching off the high frequency power source 302 and closing the valves 356, 357 to stop the introduction of the gas containing $Al(C_2H_5)_3$, the mass flow controller 341 was adjusted to 300 SCCM and $H_2$ gas from the gas reservoir 311 was fed into the deposition chamber by opening the related valves. At the same time, the mass flow controller 343 relative to $GeH_4$ gas was adjusted to 150 SCCM to feed $GeH_4$ gas from the gas reservoir 313 in the deposition chamber.

After the inner pressure of the deposition chamber became stable to be about 0.2 Torr, the high frequency power source 302 was switched on to apply a discharge energy of 150 W resulting in generating gas plasmas.

This state maintained to form a layer composed of A-Ge:Si:C:H to be the IR absorption layer on the previously formed buffer layer.

Continuing to apply said discharge energy, the above procedures were repeated, except that the introduction of the $GeH_4$ gas was stopped by closing the valves 333 and 353 and the mass flow controller 342 relative to the $SiH_4$ gas adjusted to 150 SCCM, to thereby form a layer composed of A-S:C:H to be the photoconductive layer of 20 μm in thickness on the previously formed IR absorption layer.

Then, switching off the high frequency power source 302 once, the introduction of the $H_2$ gas was stopped by closing the valves 331 and 351 and $CH_4$ gas from the gas reservoir 315 was fed. At that time, the flow rate of the $SiH_4$ gas was changed to 35 SCCM and the flow ratio of the $SiH_4$ gas to the $CH_4$ gas was adjusted to be a $SiH_4/CH_4=1/30$. After the flow rates of these gases became stable, the high frequency power source was switched on to apply a discharge energy of 150 W resulting in generating gas plasmas.

This state continued to form a layer composed of A-Si:C:H to be the surface layer of 0.5 μm in thickness on the previously formed photoconductive layer whereby a light receiving member was prepared.

The high frequency power source 302 was switched off, the related exit valves for the raw material gases were closed, the electric heater was switched off, and the vacuum atmosphere in the deposition chamber was released to atmospheric pressure.

After the aluminum cylinder being cooled to room temperature, it was taken out from the deposition chamber.

The thus obtained light receiving member was applied to positive corona discharge with a power source voltage of 5.0 KV for 0.3 second, and soon after this, the image exposure was conducted by irradiating an exposure quantity of 0.7 lux.sec through a transparent test chart using a tungsten lamp as a light source. Then, the image was developed with a negatively charged toner (containing a toner and a toner carrier) in accordance with the cascade method to develop an excellent toner image on the member surface.

The developed image was transferred to a transfer paper by applying positive corona discharge with a power source voltage of 5.0 KV and then fixed so that an extremely sharp image with a high resolution was obtained.

It was also found that defects chiefly due to insufficient contact between the intermediate layer and the substrate which are often found in the known light receiving member were remarkably eliminated and the yield was improved because of disposing the buffer layer.

EXAMPLE 9

The procedures of Example 8 were repeated, except that the layer forming conditions for the IR absorption layer were changed as shown in Table 2 to form a layer composed of A-Ge:Si:C:H in stead of the A-Ge:H layer, to thereby obtain a light receiving layer.

As a result of forming images using the resultant light receiving member by the same manner as in Example 8, there were obtained extremely clear visible images.

TABLE 2

| Layer | Gas used | Flow rate | Layer thickness | High frequency power |
|---|---|---|---|---|
| IR absorption layer | $H_2$ gas | 300 SCCM | 3 μm | 150 W |
| | $SiH_4$ gas | 75 SCCM | | |
| | $GeH_4$ gas | 75 SCCM | | |

EXAMPLE 10

The procedures of Example 8 were repeated, except that the layer forming conditions for the IR absorption layer were changed as shown in Table 3 to form a layer composed of poly-Si:Ge:H:F instead of the A-Ge:-Si:C:H layer, to thereby a light receiving member.

As a result of forming images using the resultant li9ht receiving member by the same manner as in Example 8, there were obtained extremely clear visible images.

TABLE 3

| Layer | Gas used | Flow rate | Layer thickness | High frequency power |
|---|---|---|---|---|
| IR absorption layer | $H_2$ gas | 300 SCCM | 1 μm | 200 W |
| | $SiH_4$ gas | 60 SCCM | | |
| | $GeH_4$ gas | 60 SCCM | | |
| | $SiF_4$ gas | 30 SCCM | | |

EXAMPLE 11

The procedures of Example 8 were repeated, except that the layer forming conditions for the IR absorption layer were changed as shown in Table 4 to form a layer composed of A-Si:Sn:H instead of the A-Ge:Si:C:H layer, to thereby prepare a light receiving member.

As a result of forming images using the resultant light receiving member by the same manner as in Example 8, there were obtained extremely clear visible images.

TABLE 4

| Layer | Gas used | Flow rate | Layer thickness | High frequency Power |
|---|---|---|---|---|
| IR absorption layer | $H_2$ gas | 300 SCCM | 3 μm | 150 W |
| | $SiH_4$ gas | 75 SCCM | | |
| | $SnH_4$ gas | 75 SCCM | | |

What is claimed is:

1. An improved light receiving member including on a substrate constituted principally of aluminum, a buffer layer, a 0.03 to 15 μm thick high resistance intermediate layer and a 1 to 100 μm thick photoconductive layer being disposed in this order from the side of said substrate; said buffer layer comprising a non-single-crystal containing silicon atoms and aluminum atoms to improve contact between said substrate and said high resistance intermediate layer; said high resistance intermediate layer comprising a non-single-crystal material containing silicon atoms, 10 to $5\times10^5$ atomic ppm of at least one kind of atom selected from the group consisting of oxygen atoms, carbon atoms and nitrogen atoms, and at least one kind of atom selected from hydrogen atoms and halogen atoms; and said photoconductive layer comprising an amorphous material containing silicon atoms as the main constituent and at least one kind of atom selected from the group consisting of hydrogen atoms and halogen atoms in a total amount of 1 to 40 atomic %.

2. A light receiving member according to claim 1, wherein the thickness of the buffer layer is 0.03 to 15 μm.

3. A light receiving member according to claim 1, wherein the photoconductive layer contains 0.001 to 3000 atomic ppm of an element selected from the group consisting of Group III and V elements of the Periodic Table.

4. A light receiving member according to claim 1, wherein the photoconductive layer contains 10 to $5\times10^5$ atomic ppm of at least one kind of atom selected from the group consisting of oxygen atoms, carbon atoms and nitrogen atoms.

5. A light receiving member according to claim 1, wherein a 0.003 to 30 μm thick surface layer being disposed on the photoconductive layer, said surface layer comprising an amorphous material containing silicon atoms as the main constituent and 0.001 to 90 atomic % at least one kind selected from the group consisting of oxygen atoms, carbon atoms and nitrogen atoms.

6. The light receiving member according to claim 5, wherein the surface layer contains at least one kind of atom selected from hydrogen atoms and halogen atoms.

7. An improved light receiving member including on a substrate constituted principally of aluminum, a buffer layer, a 0.03 to 15 μm thick charge injection inhibition layer and a 1 to 100 μm thick photoconductive layer being disposed in this order from the side of said substrate; said buffer layer comprising a non-single-crystal material containing silicon atoms and aluminum atoms to improve the contact between said substrate and said charge injection inhibition layer; said charge injection inhibition layer comprising a material selected from the group consisting of (a) a poly-crystalline material containing silicon atoms as the main constituent, 3 to $5\times10^4$ atomic ppm of an element selected from the group consisting of Group III and V elements of the Periodic Table and at least one kind of atom selected from the group consisting of hydrogen atoms and halogen atoms in a total amount of $1\times10^3$ to $7\times10^5$ atomic ppm and (b) an amorphous material containing silicon atoms as the main constituent, 3 to $5\times10^4$ atomic ppm of an element selected from the group consisting of Group III and V elements of the Periodic Table and at least one kind of atom selected from the group consisting of hydrogen atoms and halogen atoms in a total amount of $1\times10^4$ to $6\times10^5$ atomic ppm; and said photoconductive layer comprising an amorphous material containing silicon atoms as the main constituent and at least one kind of atom selected from the group consisting of hydrogen atoms and halogen atoms in a total amount of 1 to 40 atomic %.

8. The light receiving member according to claim 7, wherein the thickness of the buffer layer is 0.03 μm.

9. The light receiving member according to claim 7, wherein the charge injection inhibition layer contains 10 to $5\times10^5$ atomic ppm of at least one kind of atom selected from the group consisting of oxygen atoms, nitrogen atoms and carbon atoms.

10. The light receiving member according to claim 7, wherein the photoconductive layer contains 0.001 to 3000 atomic ppm of an element selected from the group consisting of Group III and V elements of the Periodic Table.

11. The light receiving member according to claim 7, wherein the photoconductive layer contains 10 to $5\times10^5$ atomic ppm of at least one kind of atom selected from the group consisting of oxygen atoms, carbon atoms and nitrogen atoms.

12. The light receiving member according to claim 7, wherein 0.003 to 30 μm thick surface layer is disposed on the photoconductive layer; said surface layer comprising an amorphous material containing silicon atoms as the main constituent and 0.001 to 90 atomic % of at least one kind selected from the group consisting of oxygen atoms, carbon atoms and nitrogen atoms.

13. The light receiving member according to claim 12, wherein the surface layer contains at least one kind of atom selected from hydrogen atoms and halogen atoms.

14. The light receiving member according to claim 7, wherein a 0.03 to 15 μm thick high resistance intermediate layer is disposed between the charge injection inhibition layer and the photoconductive layer; said high resistance intermediate layer comprising a non-single-crystal material containing silicon atoms, 10 to $5\times10^5$ atomic ppm of at least one kind of atom selected from the group consisting of oxygen atoms, carbon atoms and nitrogen atoms, and at least one kind of atom selected from hydrogen atoms and halogen atoms.

15. The light receiving member according to claim 12, wherein a 0.003 to 15 μm thick high resistance intermediate layer is disposed between the charge injection inhibition layer and the photoconductive layer; said high resistance intermediate layer comprising a non-single-crystal material containing silicon atoms, 10 to $5\times10^5$ atomic ppm of at least one kind of atom selected from the group consisting of oxygen atoms, carbon atoms and nitrogen atoms, and at least one kind of atom selected from hydrogen atoms and halogen atoms.

16. An improved light receiving member including on a substrate constituted principally of aluminum, a buffer layer, a 40 Å to 50 μm thick long wavelength light absorption layer and a 1 to 100 μm thick photoconductive layer being disposed in this order from the side of said substrate; said buffer layer comprising a non-single-crystal material containing silicon atoms and aluminum atoms to improve the contact between said substrate and said long wavelength light absorption layer; said long wavelength light absorption layer comprising a non-single-crystal material containing silicon atoms, at least one kind of atom selected from the group consisting of germanium atoms and tin atoms in a total amount of 1 to $1\times10^6$ atomic ppm and at least one kind of atom selected from the group consisting of hydrogen atoms and halogen atoms; and said photoconductive layer comprising an amorphous material containing silicon atoms as the main constituent and at least one kind of atom selected from the group consisting of hydrogen atoms and halogen atoms in a total amount of 1 to 40 atomic %.

17. The light receiving member according to claim 16, wherein the thickness of the buffer layer is 0.03 to 15 μm.

18. The light receiving member according to claim 16, wherein the photoconductive layer contains 0.001 to 3000 atomic ppm of an element selected from the group consisting of Group III and V elements of the Periodic Table.

19. The light receiving member according to claim 16, wherein the photoconductive layer contains 10 to $5\times10^5$ atomic ppm of at least one kind of atom selected from the group consisting of oxygen atoms, carbon atoms and nitrogen atoms.

20. The light receiving member according to claim 16, wherein a 0.003 to 30 μm thick surface layer being disposed on the photoconductive layer; said surface layer comprising an amorphous material containing silicon atoms as the main constituent and 0.001 to 90 atomic % of at least one kind selected from the group consisting of oxygen atoms, carbon atoms and nitrogen atoms.

21. The light receiving member according to claim 20, wherein the surface layer contains at 1east one kind of atom selected from hydrogen atoms and halogen atoms.

22. The light receiving member according to claim 16, wherein a 0.03 to 15 μm thick charge injection inhibition layer is disposed between the long wavelength light absorption layer and the photoconductive layer; said charge injection inhibition layer comprising a material selected from the group consisting of (a) a polycrystalline material containing silicon atoms as the main constituent, 3 to $5\times10^4$ atomic ppm of an element selected from the group consisting of Group III and V elements of the Periodic Table and at least one kind of atom selected from the group consisting of hydrogen atoms and halogen atoms in a total amount of $1\times10^3$ to $7\times10^5$ atomic ppm and (b) an amorphous material containing silicon atoms as the main constituent, 3 to $5\times10^4$ atomic ppm of an element selected from the group consisting of Group III and V elements of the Periodic Table and at least one kind of atom selected from the group consisting of hydrogen atoms and halogen atoms in a total amount of $1\times10^4$ to $6\times10^5$ atomic ppm.

23. The light receiving member according to claim 22, wherein the charge injection inhibition layer contains 10 to 5 $10^5$ atomic ppm of at least one kind of atom selected from the group consisting of oxygen atoms, nitrogen atoms and carbon atoms.

24. The light receiving member according to claim 16, wherein a 0.03 to 15 μm thick high resistance intermediate layer is disposed between the long wavelength light absorption layer and the photoconductive layer; said high resistance intermediate layer comprising a non-single-crystal material containing silicon atoms, 10 to $5\times10^5$ atomic ppm of at 1least one kind of atom selected from the group consisting of oxygen atoms, carbon atoms and nitrogen atoms, and at least one kind of atom selected from hydrogen atoms and halogen atoms.

25. The light receiving member according to claim 22, wherein a 0.03 to 15 μm thick high resistance intermediate layer is disposed between the charge injection inhibition layer and the photoconductive layer; said high resistance intermediate layer comprising a non-single-crystal material containing silicon atoms, 10 to $5\times10^5$ atomic ppm of at least one kind of atom selected from the group consisting of oxygen atoms, carbon atoms and nitrogen atoms, and at least one kind of atom selected from hydrogen atoms and halogen atoms.

26. The light receiving member according to claim 20, wherein a 0.03 to 15 μm thick charge injection inhibition layer is disposed between the long wavelength light absorption layer and the photoconductive layer; said charge injection inhibition layer comprising a material selected from the group consisting of (a) a polycrystalline material containing silicon atoms as the main constituent, 3 to $5\times10^4$ atomic ppm of an element selected from the group consisting of Group III and V elements of the Periodic Table and at least one kind of atom selected from the group consisting of hydrogen atoms and halogen atoms in a total amount of $1\times10^3$ to $7\times10^5$ atomic ppm and (b) an amorphous material containing silicon atoms as the main constituent, 3 to $5\times10^4$ atomic ppm of an element selected from the group consisting of Group III and V elements of the Periodic Table and at least one kind of atom selected from the group consisting of hydrogen atoms and halogen atoms in a total amount of $1\times10^4$ to $6\times10^5$ atomic ppm.

27. The light receiving member according to claim 20, wherein the charge injection inhibition layer contains 10 to $5\times10^5$ atomic ppm of at least one kind of atom selected from the group consisting of oxygen atoms, nitrogen atoms and carbon atoms.

28. The light receiving member according to claim 20, wherein a 0.03 to 15 μm thick high resistance intermediate layer is disposed between the long wavelength absorption layer and the photoconductive layer; said high resistance intermediate layer comprising a non-single-crystal material containing silicon atoms, 10 to $5\times10^5$ atomic ppm of at least one kind of atom selected from the group consisting of oxygen atoms, carbon atoms and nitrogen atoms, and at least one kind of atom selected from hydrogen atoms and halogen atoms.

29. The light receiving member according to claim 26, wherein a 0.03 to 15 μm thick high resistance intermediate layer is disposed between the charge injection inhibition layer and the photoconductive layer; said high resistance intermediate layer comprising a non-single-crystal material containing silicon atoms, 10 to $5\times10^5$ atomic ppm of at least one kind of atom selected from the group consisting of oxygen atoms, carbon atoms and nitrogen atoms, and at least one kind of atom selected form hydrogen atoms and halogen atoms.

* * * * *

UNITED STATES PATENT AND TRADEMARK OFFICE

CERTIFICATE OF CORRECTION

PATENT NO. : 4,786,573

DATED : November 22, 1988

INVENTOR(S) : HIROSHI AMADA, ET AL.

It is certified that error appears in the above-identified patent and that said Letters Patent is hereby corrected as shown below:

COLUMN 2

Line 41, "which principal" should read --the principal--.
Line 56, "peeled off" should read --peel off--.

COLUMN 4

Line 29, "of which principal" should read --of which the principal--.
Line 52, "invention is constituted" should read --invention which is constituted--.

COLUMN 5

Line 41, "polycrystlline" should read --polycrystalline--.

COLUMN 6

Line 19, "in electrification" should read --in an electrification--.

COLUMN 8

Line 51, "layer." should read --layers.--.

UNITED STATES PATENT AND TRADEMARK OFFICE

CERTIFICATE OF CORRECTION

PATENT NO. : 4,786,573

DATED : November 22, 1988

INVENTOR(S) : HIROSHI AMADA, ET AL.

It is certified that error appears in the above-identified patent and that said Letters Patent is hereby corrected as shown below:

COLUMN 12

Line 50, "was" should read --way--.

COLUMN 15

Line 37, "A-S:C:H" should read --A-Si:C:H--.

COLUMN 16

Line 20, "A-Ge:Si:C:H in stead of the A-Ge:H layer," should read --A-Ge:Si:C:H in stead of A-Ge:Si:C:H layer,--.

Line 40, "li9ht" should read --light--.

COLUMN 19

Line 30, "least" should read --least--.

Line 55, "5 $10^5$" should read --5 X $10^5$--.

UNITED STATES PATENT AND TRADEMARK OFFICE

CERTIFICATE OF CORRECTION

PATENT NO. : 4,786,573

DATED : November 22, 1988

INVENTOR(S) : HIROSHI AMADA, ET AL.

It is certified that error appears in the above-identified patent and that said Letters Patent is hereby corrected as shown below:

COLUMN 20

Line 2, "1east" should read --least--.

Signed and Sealed this

Twenty-first Day of November, 1989

*Attest:*

JEFFREY M. SAMUELS

*Attesting Officer*

*Acting Commissioner of Patents and Trademarks*